US011053634B2

(12) United States Patent
Song et al.

(10) Patent No.: US 11,053,634 B2
(45) Date of Patent: Jul. 6, 2021

(54) METHOD FOR REGULATING QUANTITY OF CONDENSING MEDIUM ACCORDING TO CHANGE IN AIR TEMPERATURE AT OUTLET OF BARREL OF DRYER

(71) Applicant: QINGDAO HAIER DRUM WASHING MACHINE CO., LTD., Shandong (CN)

(72) Inventors: Huacheng Song, Shandong (CN); Sheng Xu, Shandong (CN); Shujun Tian, Shandong (CN); Yonghong Xu, Shandong (CN); Lijun Zhang, Shandong (CN)

(73) Assignee: QINGDAO HAIER DRUM WASHING MACHINE CO., LTD., Shangong (CN)

( * ) Notice: Subject to any disclaimer, the term of this patent is extended or adjusted under 35 U.S.C. 154(b) by 342 days.

(21) Appl. No.: 16/311,930

(22) PCT Filed: Jun. 22, 2017

(86) PCT No.: PCT/CN2017/089510
§ 371 (c)(1),
(2) Date: Dec. 20, 2018

(87) PCT Pub. No.: WO2018/001158
PCT Pub. Date: Jan. 4, 2018

(65) Prior Publication Data

US 2019/0177906 A1 Jun. 13, 2019

(30) Foreign Application Priority Data

Jun. 27, 2016 (CN) ..... 201610488302.7

(51) Int. Cl.
*D06F 58/30* (2020.01)
*D06F 58/24* (2006.01)
(Continued)

(52) U.S. Cl.
CPC ..... *D06F 58/30* (2020.02); *D06F 58/24* (2013.01); *D06F 58/38* (2020.02);
(Continued)

(58) Field of Classification Search
CPC ..... D06F 58/30; D06F 58/24; D06F 58/38; D06F 2103/00; D06F 2103/38;
(Continued)

(56) References Cited

U.S. PATENT DOCUMENTS 2,686,373 A * 8/1954 Erickson ..... D06F 58/24 34/75
2,706,346 A * 4/1955 Smith ..... D06F 58/26 34/75
(Continued)

FOREIGN PATENT DOCUMENTS

CN 1746381 A 3/2006
CN 1773008 A 5/2006
(Continued)

OTHER PUBLICATIONS

International Search Report (PCT/ISA/210) dated Sep. 12, 2017, by the Chinese Patent Office as the International Searching Authority for International Application No. PCT/CN2017/089510.
(Continued)

*Primary Examiner* — Edelmira Bosques
*Assistant Examiner* — Bao D Nguyen
(74) *Attorney, Agent, or Firm* — Buchanan Ingersoll & Rooney PC

(57) ABSTRACT

A method for regulating a quantity of a condensing medium according to change in air temperature at an outlet of a barrel of the dryer comprises the following steps: Step 1, Starting drying, detecting an air temperature at the outlet of a barrel of a dryer, and determining that the air temperature at the outlet of the barrel reaches a set temperature; Step 2,
(Continued)

calculating the time value from the start of drying to the temperature at the outlet of the barrel reaching the set temperature; Step 3, determining the supplying tempo of the condensing medium at least according to the time value calculated in step 2; and Step 4, supplying the condensing medium with the supplying tempo of the condensing medium determined in step 3.

13 Claims, 2 Drawing Sheets

(51) Int. Cl.
*D06F 58/38* (2020.01)
*D06F 103/00* (2020.01)
*D06F 103/08* (2020.01)
*D06F 103/38* (2020.01)

(52) U.S. Cl.
CPC ..... *D06F 2103/00* (2020.02); *D06F 2103/08* (2020.02); *D06F 2103/38* (2020.02)

(58) Field of Classification Search
CPC ..... D06F 2103/08; D06F 2103/32; D06F 2105/20; D06F 2105/36
USPC ..... 34/497
See application file for complete search history.

(56) References Cited

U.S. PATENT DOCUMENTS 2,722,057 A * 11/1955 Pugh ..... D06F 58/24 34/74
3,875,268 A * 4/1975 DePass ..... D06F 58/24 261/88
4,257,170 A * 3/1981 Gestblom ..... G05D 22/02 34/553
4,622,759 A * 11/1986 Abe ..... D06F 34/08 34/546
4,640,022 A * 2/1987 Suzuki ..... D06F 58/30 34/552
5,161,314 A * 11/1992 Souza ..... D06F 58/30 34/493
5,207,764 A * 5/1993 Akabane ..... D06F 37/40 68/20
5,682,684 A * 11/1997 Wentzlaff ..... D06F 58/30 34/495
6,199,300 B1 * 3/2001 Heater ..... D06F 58/30 34/446
7,322,126 B2 * 1/2008 Beaulac ..... D06F 58/30 34/554
9,334,603 B2 * 5/2016 Oak ..... D06F 58/08
2004/0045327 A1 * 3/2004 Kim ..... D06F 58/24 68/19.2
2004/0216327 A1 * 11/2004 Chung ..... D06F 25/00 34/607
2005/0016010 A1 * 1/2005 Pyo ..... D06F 58/24 34/62
2005/0199016 A1 * 9/2005 Tadano ..... D06F 43/007 68/18 C
2005/0246920 A1 * 11/2005 Yabuuchi ..... D06F 58/02 34/515
2006/0048405 A1 * 3/2006 Baek ..... D06F 58/30 34/443
2006/0101587 A1 * 5/2006 Hong ..... D06F 58/30 8/149.1
2006/0101589 A1 * 5/2006 Hong ..... D06F 25/00 8/158
2006/0137105 A1 * 6/2006 Hong ..... D06F 58/24 8/147
2006/0195989 A1 * 9/2006 Jeong ..... D06F 25/00 8/158
2006/0242858 A1 * 11/2006 Beaulac ..... D06F 58/30 34/446
2008/0216517 A1 * 9/2008 Chung ..... D06F 58/30 68/12.04
2009/0183385 A1 * 7/2009 Lee ..... D06F 58/30 34/497
2009/0223082 A1 * 9/2009 Baek ..... D06F 58/30 34/497
2009/0249639 A1 * 10/2009 Kim ..... D06F 25/00 34/389
2010/0126038 A1 * 5/2010 Dreossi ..... D06F 58/30 34/572
2011/0119952 A1 * 5/2011 Nawrot ..... D06F 58/206 34/427
2012/0084996 A1 * 4/2012 Bellinger ..... D06F 58/30 34/493
2012/0084997 A1 * 4/2012 Bellinger ..... D06F 58/30 34/493
2013/0031798 A1 * 2/2013 Bae ..... D06F 58/24 34/469
2013/0152422 A1 * 6/2013 Chen ..... D06F 25/00 34/427
2013/0192085 A1 * 8/2013 Moschutz ..... D06F 58/30 34/491
2013/0198970 A1 * 8/2013 Doh ..... D06F 58/02 8/137
2013/0232813 A1 * 9/2013 Heo ..... D06F 58/30 34/515
2014/0041249 A1 * 2/2014 Jung ..... D06F 58/206 34/282
2014/0298676 A1 * 10/2014 Oak ..... D06F 58/30 34/499
2015/0168060 A1 * 6/2015 Kim ..... F26B 3/02 34/380
2016/0160419 A1 * 6/2016 Ryoo ..... D06F 58/30 68/12.14

FOREIGN PATENT DOCUMENTS

CN 102505439 A 6/2012
CN 104695193 A 6/2015
CN 105483996 A 4/2016
EP 2549007 A1 1/2013

OTHER PUBLICATIONS

Written Opinion (PCT/ISA/237) dated Sep. 12, 2017, by the Chinese Patent Office as the International Searching Authority for International Application No. PCT/CN2017/089510.

* cited by examiner

METHOD FOR REGULATING QUANTITY OF CONDENSING MEDIUM ACCORDING TO CHANGE IN AIR TEMPERATURE AT OUTLET OF BARREL OF DRYER

TECHNICAL FIELD

The disclosure refers to a technical field of dryer, in particular to a method for regulating a quantity of a condensing medium according to change in air temperature at an outlet of a barrel of the dryer.

BACKGROUND

A dryer typically has a barrel containing the fabric to be dried and a condensing device in communication with the barrel. Process air is heated to meet the moist fabric in the barrel, evaporating moisture from the fabric and becoming humid. The hot and humid process air then enters the condensing device. In the condensing device, the process air exchanges heat with a condensing medium at a lower temperature and the moisture therein is condensed and separated from the process air. During the entire drying process of the dryer, water content of the air near the condensing device varies, so that the power required for the condensing device varies during the entire working process. If the power of the condensing device is kept as same during the whole working process as is adopted in a conventional dryer, the power of the condensing device is inevitably wasted, thereby wasting resources.

Chinese patent 201410479955.X discloses a dryer and a drying method thereof and specifically discloses that the dryer comprises a control device, a barrel for containing the fabric to be dried, and a condensing device communicating with the barrel, wherein the condensing device comprises a condensing medium supplier. The method comprising determining a tempo of supplying condensing medium during the drying process at least based on the temperature of the condensing medium. The disclosure also discloses that in the drying process, the control device continuously detects changes of fabric information in the barrel and/or changes of the process air information in the drying process, to adjust the tempo of supplying condensation medium accordingly. The patent emphatically introduces a method of adjusting the tempo of supplying condensing medium according to the temperature of condensing medium. The problems with this method are as follows:

1. The temperature change of condensing medium is caused by heat dissipation of the air out from the barrel of the dryer, and it is indirect to stand for the drying process through the temperature change of condensing medium. 2. The specific heat capacity of a condensing medium, especially water, is large. Therefore, the reaction of the temperature of the condensing medium is not sensitive enough, which further affects the accuracy of the whole regulation of supplying condensing medium.

In order to reduce water consumption, the existing condensing dryer makes the following improvements on the control of water supplying for condensing. The continuous control of water supplying is carried out according to the time node, for example, after the start of drying, supplying water for 15 seconds and waiting for 5 seconds in cycles. However, this method does not take into account the influence of fabric humidity. Only by reduction of water supply, the condensation is not adequate, and it takes more time and costs more energy.

In view of this, the disclosure is specially presented.

SUMMARY

The technical problem to be solved in the present disclosure is to overcome the shortcomings of the prior art and provide a method for regulating a quantity of a condensing medium according to change in air temperature at an outlet of a barrel of the dryer.

In order to solve the above technical problems, the basic idea of the technical scheme adopted is as follows.

A method for regulating a quantity of a condensing medium according to change in air temperature at an outlet of a barrel of the dryer comprises the following steps:

Step 1. Starting drying, detecting an air temperature at the outlet of a barrel of a dryer, and determining that the air temperature at the outlet of the barrel reaches a set temperature, Step 2, calculating a time value from the start of drying to the temperature at the outlet of the barrel reaching the set temperature, Step 3, determining a supplying tempo of the condensing medium at least according to the time value calculated in step 2, and Step 4, supplying the condensing medium with the supplying tempo of the condensing medium determined in step 3.

Furthermore, no condensing medium is supplied during a process from starting drying until the air temperature at the outlet of the barrel of the dryer reaches the set temperature.

Furthermore, the supplying tempo of the condensing medium in step 3 includes at least two periods, and each period includes at least a duration of supplying the condensing medium determined according to the time value.

Furthermore, the longer the time value for the air temperature at the outlet of the dryer to reach the set temperature, the longer the duration of supplying the condensing medium is in at least one period.

Furthermore, the supplying tempo of the condensing medium in step 3 includes at least two periods, and each period includes a unit duration and a time interval of supplying the condensing medium which are determined according to the time value.

Furthermore, the longer the time value for the air temperature at the outlet of the barrel of the dryer to reach the set temperature, the larger the proportion of one unit duration for supplying the condensing is in at least one period.

Furthermore, a drying process after the air temperature at the outlet of the barrel reaches the set temperature is divided into at least two stages, including a first stage and a last stage, and the supplying tempo of the condensing medium changes with the drying stages.

Furthermore, drying stages are divided according to a changing rate of the air temperature at the outlet of the barrel. The changing rate of the air temperature determined at the outlet of the barrel of the dryer is less than the set changing rate in the dryer in a first stage, the changing rate of the air temperature determined at the outlet of the barrel of the dryer is greater than the set changing rate in the dryer in a second stage, and each stage includes a unit duration and a time interval of supplying the condensing medium.

Furthermore, when the changing rate of the air temperature determined at the outlet of the barrel of the dryer is less than the set changing rate in the dryer, the unit duration of supplying the condensing medium is increased, and when the changing rate of the air temperature determined at the outlet of the barrel of the dryer is greater than the set changing rate in the dryer, the unit duration of supplying the condensing medium is reduced.

Furthermore, the longer the time value for the air temperature at the outlet of the barrel of the dryer to reach the set temperature, the larger the proportion of a duration for an initial supply of the condensing medium to a duration for a later supply of condensing medium is.

The dryer comprises a control device, a heating device, a barrel for fabric to be dried, a condensing device connected with the barrel and a temperature monitoring device for detecting the air temperature at an outlet of the barrel. The condensing device comprises a condensing medium supplier. The control device is set to control the operation of the dryer according to the above method.

After the dryer starts up, the control device controls the heating device to work and provides heated air to the barrel. After the heated air exchanges heat with the fabric in the barrel, the water in the fabric evaporates to form water vapor which is discharged from the barrel. The temperature monitoring device detects the air temperature at the outlet of the barrel, and the control device controls the condensing medium supplier open or closed according to the detected air temperature at the outlet of the barrel.

A first tempo of supplying the condensing medium is determined according to the time value for the detected air temperature at the outlet of the barrel to reach the set temperature, a second tempo of supplying the condensing medium is determined according to the change rate of the air temperature at the outlet of the barrel, and the condensing medium is supplied through the cooperation of the first tempo and the second tempo.

It is an early stage of drying from the beginning of drying to the time when the air temperature at the outlet of the barrel reaches the set temperature. In the early stage, the control device controls the condensing medium supplier closed and no condensing medium is provided. The time of the early stage affects the amount of the condensing medium supplied. The longer the time, the more moisture in the fabric, and the longer the duration of supplying the condensing medium is subsequently. When the air temperature at the outlet of the barrel rises to the set temperature, the control device intervally controls the condensing medium supplier to open or close to condense the moisture in the outlet air. Since most of the heat of the air entering the barrel is absorbed by water in the fabric, the air temperature at the outlet of the barrel changes a little, that is, the change rate of the air temperature at the outlet of barrel is less than a set change rate, and the amount of water evaporated is the largest. In this stage, the time of supplying the condensing medium is prolonged. With the process of drying going on, the content of moisture in the fabric becomes less and less, and the change rate of air temperature at the outlet of the barrel is larger than the set change rate. In this stage, the time of supplying the condensing medium is shortened and the time interval of the supplying device to supply the condensing medium is prolonged.

Water is preferably selected as the condensing medium of the disclosure to condense the moisture in the outlet air of the barrel.

After adopting the above technical scheme, the disclosure has the following beneficial effects compared with the prior art: the dryer adjusts the amount of the condensing medium supplied in a unit time, according to the change of air temperature at the the outlet of the barrel, thus ensuring the drying efficiency and avoiding the waste of the condensing medium.

The detailed implementation of the disclosure is further described in detail with the accompanying drawings.

BRIEF DESCRIPTION OF THE DRAWINGS

The drawings are intended to provide a further understanding of the disclosure and to be illustrative of the disclosure, not to be improper limitation of the present disclosure. It is apparent that the drawings in the following description are merely some embodiments, and other drawings may be obtained from those skilled in the art without creative work from the drawings.

In the drawings.

DETAILED DESCRIPTION

Figure 1:
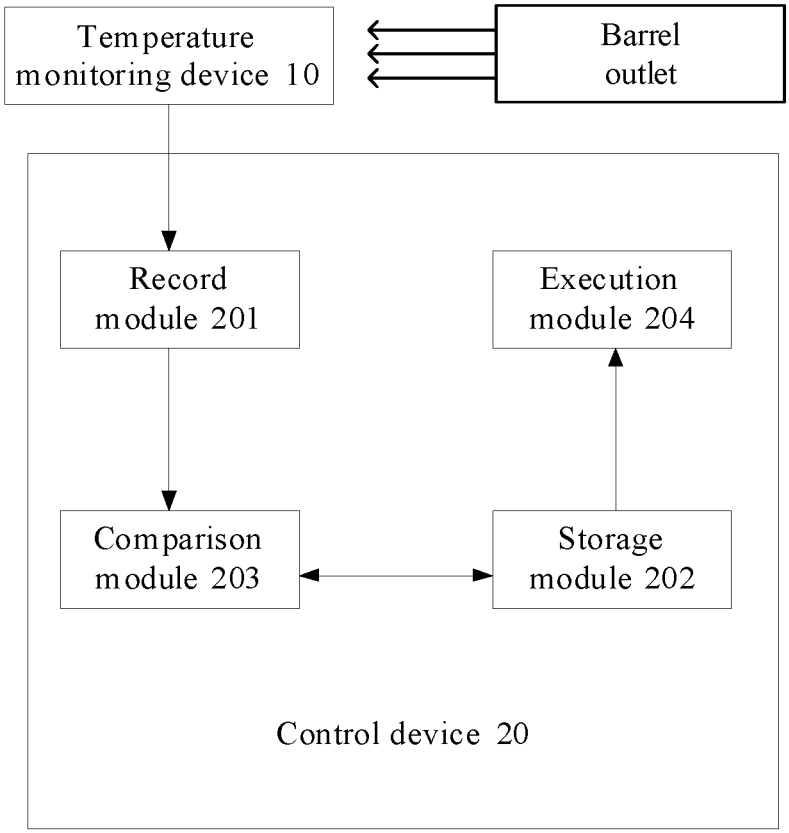
FIG. 1 is a schematic diagram of functional modules of a control device of a dryer in an embodiment of the present disclosure.

The embodiments of the present disclosure will be clearly and completely described in conjunction with drawings, to make the purpose, technical solutions and advantages of the embodiments more clear. The following embodiments are used to illustrate the present disclosure, but not intended to limit the scope of the disclosure.

The dryer has a case body and a barrel mounted inside the case body. An air inlet and an outlet of the barrel are respectively communicated with a heating device and a condensing device. A blast device is arranged between the heating device and the condensing device, thus promotes the air to flow between the barrel, the heating device and the condensing device. At the same time, the outlet of the barrel is equipped with a temperature monitoring device to obtain the air temperature at the outlet.

The condensing device comprises an air passage and a condensing medium supplier. The condensing medium supplier comprises a condensing medium path associated with the air passage by heat conduction and a supply element on the condensing medium path. The supply element is controlled open or closed by a control device. The temperature monitoring device is electrically connected with the control device, so that temperature information detected can be sent to the control device.

As one specific embodiment of the condensing device, the condensing medium is water, the supply element is a water valve, the condensing medium path is a water pipeline outside the air passage, and the part in the air passage can be extended downward directly along the inner wall of the air passage without a separate pipeline. Or, the water sprays down in the air passage.

In the drying process, the air is heated by the heating device and is fed into the barrel by the blast device, to meet the humid fabric and evaporate the moisture therein. The hot and humid air then enters the air passage of the condensing device, wherein it exchanges heat with the condensing medium in the condensing medium path, so the temperature of the outlet air decreases, and the water in the outlet air is condensed and separated from the outlet air. Afterwards, after drying and condensation, the air enters the heating device again, and after heating, it enters a next cycle, thus gradually separating the moisture from the fabric.

In the drying process above, the supply of the condensing medium is determined by the supply element and controlled by the control device. The supply element is turned on/off at a certain tempo.

A method for regulating a quantity of a condensing medium according to change in air temperature at an outlet of a barrel of the dryer comprises the following steps:

Step 1, Starting drying, detecting an air temperature at the outlet of a barrel of a dryer, and determining that the air temperature at the outlet of the barrel reaches a set temperature, Step 2, calculating the time value from the start of drying to the temperature at the outlet of the barrel reaching the set temperature, Step 3, determining the supplying tempo of the condensing medium at least according to the time value calculated in step 2, and Step 4, supplying the condensing medium with the supplying tempo of the condensing medium determined in step 3.

Furthermore, in order to ensure that the fabric in the dryer reaches a required temperature as soon as possible, at the beginning of drying, that is, before the air temperature at the outlet reaches the set temperature, no water is supplied. At this stage, the fabric in the dryer is in a heating-up process and less water is evaporated, and the heating-up rate of the fabric in the dryer is inevitably affected if water is supplied at this time, not conducive to the evaporation of the whole drying cycle.

Corresponding to the above method, as shown in FIG. 1, one embodiment of the above method is as follows. The control device of the dryer comprises a storage module 202, a record module 201, a comparison module 203 and an execution module 204. The set temperature of step 1 is stored in the storage module 202. The record module 201 is used to record the time taken for the air temperature at the outlet of the dryer to reach the set temperature. A control program corresponding to certain time intervals are stored in the storage module 202. The control program is used to control the tempo of supplying a condensing medium. The comparison module 203 compares the time taken for the air temperature at the outlet of the dryer to reach the set temperature which is record by the record module 201 with time intervals stored in the storage module 202. The time falls in a time interval, and the control program controls the execution module 204 to supply the condensing medium in a corresponding tempo.

Figure 2:
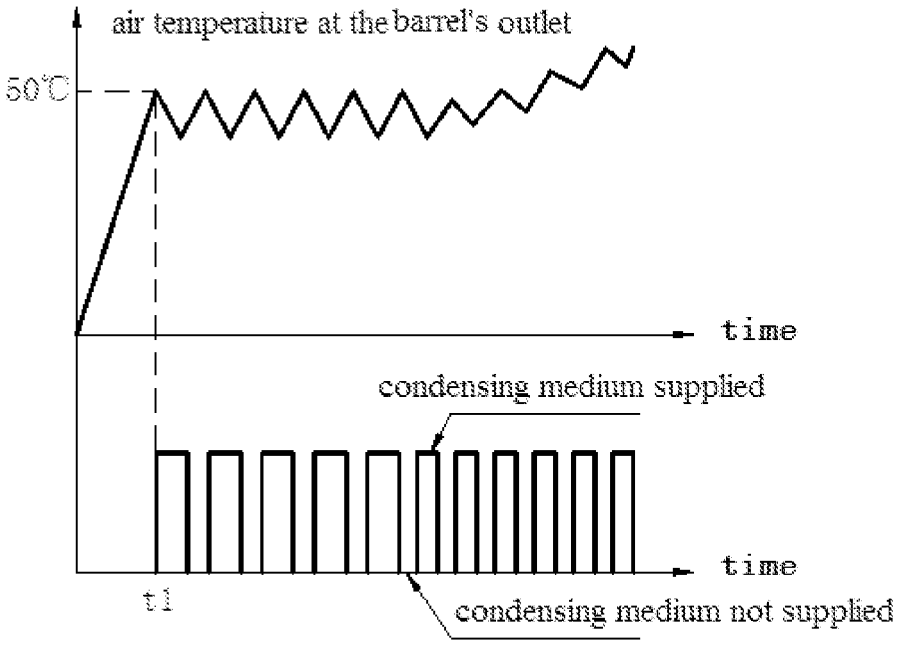
FIG. 2 is a schematic diagram of curve of changes of condensing medium and air temperature at a barrel's outlet of a dryer over time in an embodiment of the present disclosure.
Figure 3:
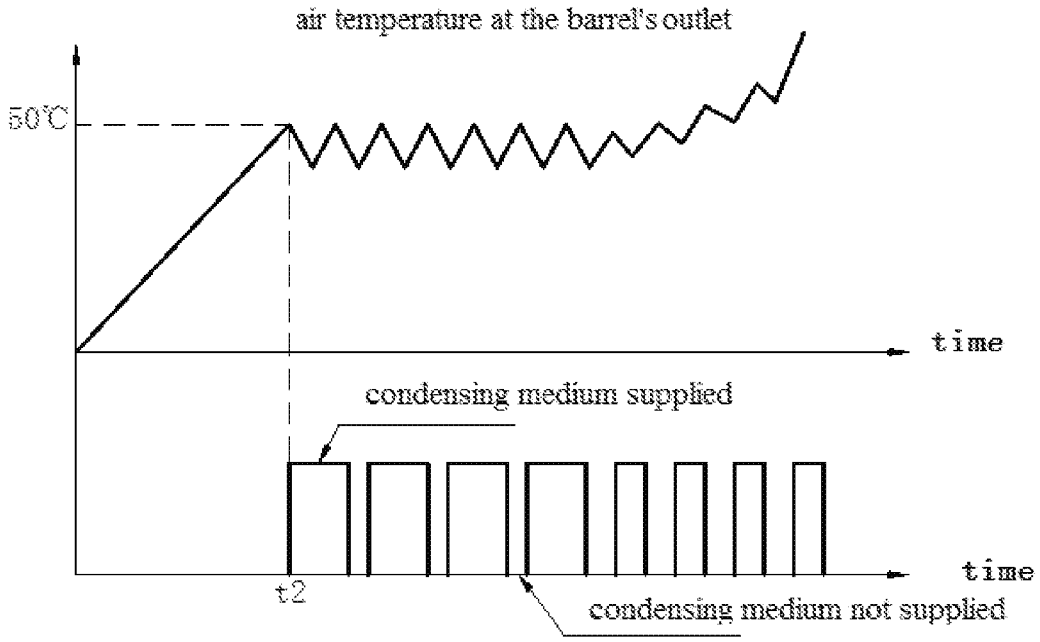
FIG. 3 is a schematic diagram of a curve of change of condensing medium and air temperature at a barrel's outlet of a dryer over time in another embodiment of the present disclosure.

In a specific embodiment, the set temperature of the dryer in step 1 is set to 50° C. and the condensing medium is water. As shown in FIG. 2 and FIG. 3, the greater a time t2 for the air temperature at the outlet of the dryer to reach the set temperature of 50° C., the more moisture in the fabric, and the time of supplying water is longer (see FIG. 3). The shorter a time t1 for the air temperature at the outlet of the dryer to reach the set temperature of 50° C., the less moisture in the fabric, $t1<t2$, and the time of supplying water is shorter (see FIG. 2).

The supplying tempo of the condensing medium in step 3 includes two periods. Each period includes a unit duration and a time interval of supplying the condensing medium which are determined according to the time value, corresponding to the condensing medium being supplied or not supplied shown in FIG. 2 and FIG. 3. The greater the time for the air temperature at the outlet of the dryer to reach the set temperature, the larger the proportion of the unit duration of supplying the condensing medium is in a first cycle.

The principle of the disclosure is as follows: air enters into the dryer and exchange heat with the water in the fabric. Water in the fabric evaporates into the air, so that the air is hot and humid. In a condensing dryer, hot and humid air enters into the condenser and exchanges heat with the condensing medium. The temperature of air decreases and the humidity is saturated, so that the water in the air is condensed into liquid state and separated. If there is more water in the fabric, the temperature of the air at the outlet of the barrel will rise slowly because most of the heat of the air entering into the barrel is absorbed by the water. Although the temperature is low, the actual content of water vapor is large. If there is little water in the fabric, the temperature of the air at the outlet of the barrel will rise quickly because a little of the heat of the air entering into the barrel is absorbed by the water, and the actual content of water vapor is small. Therefore, it is possible to adjust the amount of the condensing medium supplied according to the heating rate of the air at the outlet of the barrel, to condense the water vapor more quickly.

During the whole working process of the dryer, the temperature at the outlet of the barrel is gradually increased, and the content of the moisture in the fabric is gradually decreased. Therefore, the time of supplying water is refined according to different stages of the drying process. After the dryer works for a period of time, most of the heat of the air entering the barrel is absorbed by the moisture in the fabric, and the temperature at the outlet of the barrel changes slowly. At this time, the amount of water evaporated is the most. At this time, the time of supplying condensing water is longer in a cycle. In the later stage of drying, as the content of moisture in the fabric decreases, the temperature at the outlet of the barrel rises at a high rate, and at this time, the water in the air at the outlet of the barrel is condensed, in reduced time of supplying water for condensing.

Specifically, it is an early stage of drying from the beginning of drying to the time when the air temperature at the outlet of the barrel reaches the set temperature. In the early stage, the control device controls the condensing medium supplier to close and no condensing medium is provided. The time of the early stage affects the amount of the condensing medium supplied. The longer the time, the more moisture in the fabric, and the longer the duration of supplying the condensing medium subsequently is. When the air temperature at the outlet of the barrel rises to the set temperature, the control device intervally controls the condensing medium supplier to open or close to condense the moisture in the outlet air. Since most of the heat of the air entering the barrel is absorbed by water in the fabric, the air temperature at the outlet of the barrel changes a little, that is, the change rate of the air temperature at the outlet of barrel is less than a set change rate, and the amount of water evaporated is the largest. In this stage, the time of supplying the condensing medium is prolonged. With the process of drying going on, the content of moisture in the fabric becomes less and less, and the change rate of air temperature at the outlet of the barrel is larger than the set change rate. In this stage, the time of supplying the condensing medium is shortened and the time interval of the supplying device to supply the condensing medium is prolonged.

Drying stages are divided according to the changing rate of the air temperature at the outlet of the barrel. The changing rate of the air temperature determined at the outlet of the barrel of the dryer is less than the set changing rate in the dryer in a first stage, the changing rate of the air temperature determined at the outlet of the barrel of the dryer is greater than the set changing rate in the dryer in a second stage, and each stage includes a unit duration and a time interval of supplying the condensing medium.

When the changing rate of the air temperature determined at the outlet of the barrel of the dryer is less than the set changing rate in the dryer, the unit duration of supplying the condensing medium increased. When the changing rate of the air temperature determined at the outlet of the barrel of the dryer is greater than the set changing rate in the dryer, the unit duration of supplying the condensing medium reduced.

Furthermore, the longer the time for the air temperature at the outlet of the barrel of the dryer to reach the set temperature, the larger the proportion of a duration for an initial supply of the condensing medium to a duration for a later supply of condensing medium is (see FIG. 3).

The foregoing is merely illustrative of the preferred embodiments of the present disclosure and is not intended to be limiting of the present disclosure. While the disclosure has been disclosed by way of example with reference to the preferred embodiments, it is not intended to be limiting of the disclosure. Any person skilled in the art will, without departing from the scope of the technical solution of the present disclosure, may make use of the technical contents of the above-mentioned tips to make some alterations or modifications to equivalent embodiments, but without departing from the scope of the technical solution of the present disclosure. Any and all modifications, equivalents, and modifications of the foregoing embodiments are within the scope of the present disclosure without departing from the spirit of the technical solution of the present disclosure in accordance with the technical details of the present disclosure.

The invention claimed is:

1. A method for regulating a quantity of a condensing medium according to change in air temperature at an outlet of a barrel of a dryer, comprising following steps:

step 1, starting drying, detecting an air temperature at the outlet of the barrel of the dryer, and determining that the air temperature at the outlet of the barrel reaches a set temperature, step 2, calculating a time value from a start of drying to the air temperature at the outlet of the barrel reaching the set temperature, step 3, determining a supplying tempo of the condensing medium at least according to the time value calculated in step 2, and step 4, supplying the condensing medium with the supplying tempo of the condensing medium determined in step 3.

2. The method for regulating the quantity of the condensing medium according to change in air temperature at the outlet of the barrel of the dryer according to claim 1, wherein no condensing medium is supplied during a process from the start of drying until the air temperature at the outlet of the barrel of the dryer reaches the set temperature.

3. The method for regulating the quantity of the condensing medium according to change in air temperature at the outlet of the barrel of the dryer according to claim 2, wherein the supplying tempo of the condensing medium in step 3 includes at least two periods, and each period includes at least a duration of supplying the condensing medium determined according to the time value.

4. The method for regulating the quantity of the condensing medium according to change in air temperature at the outlet of the barrel of the dryer according to claim 2, wherein the supplying tempo of the condensing medium in step 3 includes at least two periods, and each period includes a unit duration and a time interval for supplying the condensing medium which are determined according to the time value.

5. The method for regulating the quantity of the condensing medium according to change in air temperature at the outlet of the barrel of the dryer according to claim 2, wherein a drying process after the air temperature at the outlet of the barrel reaches the set temperature is divided into at least two stages, including a first stage and a last stage, and the supplying tempo of the condensing medium changes with the drying stages.

6. The method for regulating the quantity of the condensing medium according to change in air temperature at the outlet of the barrel of the dryer according to claim 1, wherein the supplying tempo of the condensing medium in step 3 includes at least two periods, and each period includes at least a duration of supplying the condensing medium determined according to the time value.

7. The method for regulating the quantity of the condensing medium according to change in air temperature at the outlet of the barrel of the dryer according to claim 6, wherein the longer the time value for the air temperature at the outlet of the dryer to reach the set temperature is, the longer the duration of supplying the condensing medium is in at least one period.

8. The method for regulating the quantity of the condensing medium according to change in air temperature at the outlet of the barrel of the dryer according to claim 1, wherein the supplying tempo of the condensing medium in step 3 includes at least two periods, and each period includes a unit duration and a time interval for supplying the condensing medium which are determined according to the time value.

9. The method for regulating the quantity of the condensing medium according to change in air temperature at the outlet of the barrel of the dryer according to claim 8, wherein the longer the time value for the air temperature at the outlet of the barrel of the dryer to reach the set temperature is, the larger a proportion of the unit duration for supplying the condensing is in at least one period.

10. The method for regulating the quantity of the condensing medium according to change in air temperature at the outlet of the barrel of the dryer according to claim 1, wherein a drying process after the air temperature at the outlet of the barrel reaches the set temperature is divided into at least two stages, including a first stage and a last stage, and the supplying tempo of the condensing medium changes with the drying stages.

11. The method for regulating the quantity of the condensing medium according to change in air temperature at the outlet of the barrel of the dryer according to claim 10, wherein drying stages are divided according to a changing rate of the air temperature at the outlet of the barrel, a stage in which the changing rate of the air temperature determined at the outlet of the barrel of the dryer is less than a set changing rate in the dryer is the first stage, a stage in which the changing rate of the air temperature determined at the outlet of the barrel of the dryer is greater than the set changing rate in the dryer is the last stage, and each stage includes a unit duration and a time interval of supplying the condensing medium.

12. The method for regulating the quantity of the condensing medium according to change in air temperature at the outlet of the barrel of the dryer according to claim 11, wherein when the changing rate of the air temperature at the outlet of the barrel of the dryer is less than the set changing rate in the dryer, the unit duration of supplying the condensing medium is increased, and when the changing rate of the air temperature at the outlet of the barrel of the dryer is greater than the set changing rate in the dryer, the unit duration of supplying the condensing medium is reduced.

13. The method for regulating the quantity of the condensing medium according to change in air temperature at the outlet of the barrel of the dryer according to claim 11, wherein the longer the time value for the air temperature at the outlet of the barrel of the dryer to reach the set temperature is, the larger a proportion of a duration for an initial supply of the condensing medium to a duration for a later supply of the condensing medium is.

* * * * *